US011078041B2

(12) United States Patent
Köhn et al.

(10) Patent No.: US 11,078,041 B2
(45) Date of Patent: Aug. 3, 2021

(54) MONITORING METHOD FOR MONITORING AN UNWINDING PROCESS, UNWINDING DEVICE AND UNWINDING SYSTEM

(71) Applicant: Windmöller & Hölscher KG, Lengerich (DE)

(72) Inventors: Uwe Köhn, Osnabrück (DE); Oliver Huil, Osnabrück (DE)

(73) Assignee: Windmöller & Hölscher KG, Lengerich (DE)

( * ) Notice: Subject to any disclaimer, the term of this patent is extended or adjusted under 35 U.S.C. 154(b) by 276 days.

(21) Appl. No.: 15/956,593

(22) Filed: Apr. 18, 2018

(65) Prior Publication Data

US 2018/0305159 A1 Oct. 25, 2018

(30) Foreign Application Priority Data

Apr. 21, 2017 (DE) ..... 10 2017 108 495.9

(51) Int. Cl.
*B65H 18/14* (2006.01)
*B21B 38/04* (2006.01)
*B65H 26/02* (2006.01)

(52) U.S. Cl.
CPC ..... *B65H 18/145* (2013.01); *B21B 38/04* (2013.01); *B65H 26/02* (2013.01); *B65H 2301/41501* (2013.01); *B65H 2553/42* (2013.01); *B65H 2557/60* (2013.01); *B65H 2557/62* (2013.01)

(58) Field of Classification Search
CPC ..... B65H 18/145; B65H 26/02; B21B 38/04
See application file for complete search history.

(56) References Cited

U.S. PATENT DOCUMENTS 5,971,315 A * 10/1999 Kojo ..... B65H 18/08 242/534.2
6,098,063 A * 8/2000 Xie ..... G06N 5/025 706/60
8,763,945 B2 * 7/2014 Gruzdaitis ..... B65H 23/198 242/413

(Continued)

FOREIGN PATENT DOCUMENTS

DE 4432371 A1 3/1996
DE 19882374 B4 4/2006

(Continued)

OTHER PUBLICATIONS

Office Action for German application No. 10 2017 108 495.9 dated Dec. 15, 2017, with an English summary, 8 pages.

(Continued)

*Primary Examiner* — Bryan Bui
(74) *Attorney, Agent, or Firm* — Rudy J. Ng; Bret E. Field; Bozicevic, Field & Francis LLP

(57) ABSTRACT

The invention relates to a monitoring method (100) for monitoring an unwinding process of an unwinding device (2), comprising the following steps:

Figure 1:
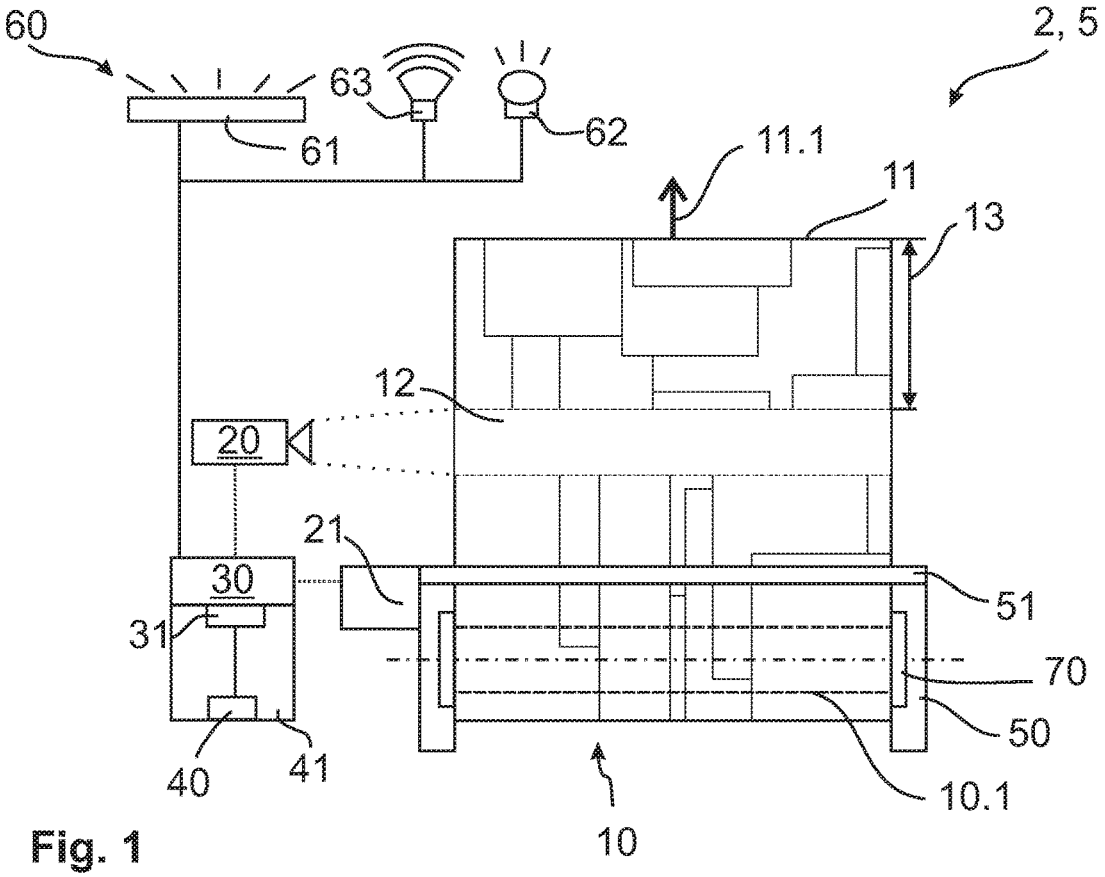

at least partially unwinding (101) a web material (11) from a reel (10), detecting (102) at least one irregularity (12) of the web material (11) and/or the unwinding process.

Furthermore, the invention relates to an unwinding device (2) for performing an unwinding process as well as an unwinding system (5) for performing an unwinding process.

17 Claims, 3 Drawing Sheets

(56) References Cited

U.S. PATENT DOCUMENTS

| | | | | |
|---|---|---|---|---|
| 9,221,641 | B2 * | 12/2015 | Dollevoet ..... | B65H 35/08 |
| 2006/0038051 | A1 * | 2/2006 | Betti ..... | B65H 16/10 242/420.3 |
| 2010/0063750 | A1 | 3/2010 | Floeder et al. | |
| 2011/0224918 | A1 | 9/2011 | Floeder et al. | |

FOREIGN PATENT DOCUMENTS

| | | | |
|---|---|---|---|
| DE | 102009029083 | A1 | 3/2011 |
| DE | 102015213709 | A1 | 1/2017 |
| EP | 0358236 | | 3/1990 |

OTHER PUBLICATIONS

Extended European Search Report for European Application No. 18163411.4 dated Sep. 26, 2018, with an English summary, 9 pages.
Examination Report for European Application No. 18163411.4 dated Apr. 16, 2020, with its English summary, 7 pages.

* cited by examiner

MONITORING METHOD FOR MONITORING AN UNWINDING PROCESS, UNWINDING DEVICE AND UNWINDING SYSTEM

The present invention relates to a monitoring method for monitoring an unwinding process, an unwinding device for performing an unwinding process of a web material and an unwinding system.

In order to convey a continuous material, such as a manufactured film, in the distribution or to the place of use, these are often provided portioned in the form of reels. Such reels are initially wound on a winding device in order to be correspondingly unwound by an unwinding device at the place of use. The unwinding is often followed by the following further processing processes: for example, the generation of plastic sacks, the wrapping of stacked packaged goods for load securing or the like. During the unwinding process of the reel, however, defects may occur, which are caused in the production process of the reel, i.e. in the production of the film and/or during the winding or which are caused during a defective unwinding. Therefore, it is desirable to be able to recognize such defects and, in the best case, draw a conclusion about the cause of the defect.

From the prior art, it is also known to store relevant data of an unwinding process with a time stamp in order to draw conclusions about the course of a production. The disadvantage here, however, is that the time indication alone often yields inaccurate conclusions, since the exact winding parameters are unknown. Thus, such reels are often equipped with a weight indication, but without allowing an accurate conclusion as to which thickness of the film material is actually provided for the reel. A varying thickness of the film material may also result in inaccuracies according to the calculation of the film diameter. Furthermore, air inclusions in the reel can cause further inaccuracies, so that a reliable conclusion on the position to the relevant data in the reel is not enabled.

It is an object of the present invention to at least partially overcome the previously mentioned disadvantages known from the prior art. In particular, it is an object of the present invention to improve a conclusion from an unwinding process to a production process of a reel in terms of reliability and/or accuracy.

The above object is achieved by a monitoring method with the features of the present disclosure and an unwinding device with the features of the present disclosure and an unwinding system with the features of the present disclosure.

Further features and details of the invention will become apparent from the dependent claims, the description and the drawings. In this case, features and details that have been described in connection with the monitoring method according to the invention apply, of course, also in connection with the unwinding device according to the invention and/or the unwinding system according to the invention and in each case vice versa, so that mutual reference is or can always be made with respect to the disclosure of the individual inventive aspects.

According to the invention, the monitoring method for monitoring an unwinding process of an unwinding device comprises at least the following steps:

- at least partially unwinding a web material from a reel,
- detecting at least one irregularity of the web material and/or the unwinding process,
- determining a correlation of the irregularity to at least one running parameter of the reel.

During the unwinding the reel may preferably be stored on a reel holder. In this case, the reel in particular has a reel sleeve and at least a portion of the web material. During unwinding, the web material is thereby reduced on the reel and preferably conveyed to a further processing station. Preferably, the web material may comprise a plastic film. Thus, plastic films have a complex production process in which, if necessary, many parameters have to be taken into account, so that an exchange of information between individual processes in the case of plastic films is particularly advantageous. Additionally or alternatively, however, further materials of the web material are conceivable. The detection of the at least one irregularity of the web material and/or the unwinding process can be performed in particular by a sensor or computational. For example, a detection unit may be provided by which an irregularity is detected. Preferably, the irregularity can be detected optically and/or acoustically. For example, the detection unit can be configured to detect the irregularity by means of ultrasound and/or can have a camera. Furthermore, it is conceivable that the irregularity is detected electronically and/or computational, e.g. by measuring a required current of a driving means or the like to conclude on a driving power. An irregularity may, in particular, be understood as a critical or uncritical feature in the processing process during the unwinding. Thus, the irregularity may preferably comprise a defect exhibited by the web material. For example, the irregularity may comprise at least one of the following features:

- unsuccessful opening of a tube of the web material,
- breaking up of a product produced from the web material,
- tearing of the web material,
- absence of at least one part of a printed image on the web material,
- increased slip on a driving means during unwinding of the web material,
- altered torques and/or forces during processing of the web material.

Thus, the irregularity may affect the web material and/or the unwinding process directly or indirectly. For example, it may be provided that the web material is wound up as a tube, which is opened during unwinding or after unwinding, so that a three-dimensional shape arises from a previously folded tube. Furthermore, it can also be recognized that the web material, for example, does not withstand the processing of the web material into sacks and that a corresponding sack tears. Such tearing can also occur during unwinding or shortly after unwinding, so this can represent a possible irregularity. Furthermore, the web material may have a printed image. For example, for the production of plastic sacks, the web material may initially be printed before it is wound up. If a part of this printed image is absent, e.g. due to lack of color in a printer unit, this can be detected as an irregularity in the unwinding. Under a changed slip it can be further understood during unwinding of the web material, that a driving means, which ensures a propulsion of the web material, at least partially slips. The speed of the driving and the speed of the web material differ accordingly. Furthermore, forces and/or torques can be measured at different positions during the unwinding process, which can be an indicator of the occurrence of an irregularity.

The running parameter may preferably also be referred to as a running meter. In particular, the running parameter may comprise the actual unwound length of the web material from the reel until the occurrence of the irregularity. In this case, the length can be related to the irregularity in different ways, i.e. it can be correlated. Thus, the running parameter may comprise a length ranging from the starting position of the web material, i.e. for example, from the first unwound end of the web material, to the beginning of the irregularity, to the end of the irregularity, or to an average value between the beginning and the end of the irregularity. In particular, the correlation of the irregularity to the running parameter can thus be understood as an assignment of a specific value of the running parameter to a position of the irregularity relative to the reel and/or vice versa. In particular, the running parameter is accordingly also correlated or interdependent on the irregularity. For example, if the irregularity comprises the absence of a printed image, the running parameter may comprise the length from the beginning of the unwinding of the web material to the beginning of the absence of the printed image and/or to the end of the absence of the printed image. Further, the running parameter may comprise the length of the unwound material until the irregularity occurs in the form of a particular event, e.g. a change of forces and/or torques. Thus, the correlation between the irregularity and the running parameter may be understood to relate the irregularity, particularly the occurrence of the irregularity, to the running parameter. This can be performed, for example, by providing a table having at least two columns, the irregularity being written into the first column and the running parameter or a value of the running parameter in the second column of the table, so that it can be traced back to which position in the reel the irregularity has occurred. In particular, a field variable of a computer program may be provided instead of the table or provide the table. In particular, this clarifies that the irregularity is assigned to a value of the running parameter, therefore occurs at a position of the running parameter. Also an accumulation of irregularity in a certain range of the running parameter can be thereby determined.

By the monitoring method according to the invention, it is thus possible to indicate the position of the irregularity in the reel. As a result, conclusions can be drawn on defects during the production of the reel and/or during the unwinding of the reel. Thus, for example, an increased occurrence of an irregularity in the core of the reel can suggest that it was wound up during winding with an enlarged reel hardness. Thereby, the production process of the reel can be improved. Furthermore, an estimation can be made as to whether the irregularity has occurred due to a defect in the unwinding process. This may be relevant for warranty issues, for example, if the question arises as to whether the reel has exhibited a defect when it has been delivered to a customer or if the defect has arisen due to a faulty handling of the reel. By means of the monitoring method according to the invention, a further indicator in the question of proof can be provided here. Thus, the monitoring process may further comprise the following step:

evaluating the correlation between the irregularity and the running parameter.

The evaluation can also be performed automatically, for example, based on predetermined criteria, in particular by means of a computing unit. As a result, it is thus also possible for a corresponding conclusion to a cause of the irregularity to be performed automatically in the context of the method, and the conclusion thus to have a reproducible accuracy. In particular, by the use of the running parameter of the reel, the running parameter is related to the same reel, so that the conclusions can be attributable to a specific reel also based on its production.

In the context of the invention, it is also conceivable that the running parameter is determined during the unwinding of the web material from the reel. Preferably, the running parameter can be determined continuously during the unwinding of the web material from the reel. Determining the running parameter may comprise a direct measurement of the running parameter. For example, the running parameter can thus be continuously detected and recorded, during unwinding, so that a value corresponding to the irregularity is immediately available when the irregularity is detected. Alternatively, the running parameter may not be determined continuously during the unwinding process, for example by measuring the running parameter only when an irregularity is detected. A continuous detection of the running parameter may comprise an analog and/or a digital measurement of the running parameter. Thus, a detection means for detecting the running parameter can work incrementally and, for example, output a signal after a certain length or rotation, by which the running parameter can be concluded. By detecting the running parameter during unwinding, for example, it is not necessary to manually measure it, so that the monitoring method can be further automated and thus costs can be reduced, while at the same time a reproducible, high accuracy can be provided.

Preferably, the running parameter can be determined by detecting an advance parameter on the web material. Preferably, a measurement of a number of rotations of the reel can additionally be performed. The advance can be understood as a portion of a driving means which acts on the web material in order to allow a propulsion. An advance parameter may comprise a speed, in particular a rotational speed and/or a tangential speed of a drive roll at the advance. The measurement of the advance parameter can be set directly in relation to the actually unwound length and thus a high-quality indicator for the running parameter. At the advance, the web material is already running in a flat extension, so that accordingly changing diameters of the reel at the advance do not or only play a small role. However, particularly preferably, the running parameter can be determined by measuring the advance parameter and by measuring the number of rotations of the reel. The measurement of the number of rotations of the reel permits a correction of the advance parameter, wherein here, preferably, an estimate of the diameter of the reel can be given. Thus, the actual measurement of the running parameter can occur at the advance, but it can be corrected based on of the measurement of the number of rotations of the reel in order to at least partially eliminate slip at the advance. This results in a high accuracy of the determination of the running parameter, so that in particular a conclusion on the cause of the irregularity can be improved in its accuracy.

It is further conceivable in a monitoring method according to the invention that the monitoring method further comprises the following step:

entering the correlation of the irregularity to the running parameter in a database.

A database may preferably be considered as an electronic table. Thus, for example, a SQL server can be maintained on a storage medium, which provides a corresponding database. In particular, the correlation of the irregularity to the running parameter can be determined by relating the irregularity and the running parameter in such a way that they can be assigned to one another when being entered into the database. In addition, for example, after the unwinding process or at another time the database can be viewed and the correlation between the irregularity and the running parameter can be reproduced. For example, several irregularities can be evaluated together after the course of an unwinding process, or several irregularities from several different unwinding processes can be evaluated together. For example, a conclusion can only emerge from the fact that several reels of a charge are examined together for irregularities over the database, so that a pattern emerges only when examining the several reels. Thus, by entering the irregularity and the running parameter into a database, there is an improvement in the possibility of drawing conclusions from the data obtained on the related processing processes or production processes.

It is also conceivable in a monitoring method according to the invention that the irregularity is further correlated to a time indication when entering the correlation into the database. Thus, for example, a first correlation with the running parameter can be determined and a second correlation can be generated or determined with the time. The time indication may comprise a time, in particular a time of day, of the time of occurrence of the irregularity. For example, the time indication may be provided as a third column in a table of the database. By detecting the time or the time of occurrence of the irregularity, the conclusions can also be further improved, which can be drawn therefrom. Thus, for example, it can be estimated whether irregularities occur more frequently in the working shift of a specific operator than in another working shift, so that incorrect operations during the unwinding process can be identified here. Furthermore, the time indication may allow a conclusion about a relation of an occurrence of the irregularity and a further event during the unwinding process, such as, for example, a power failure. As a result, there are several relations between the irregularity, the time indication and the running parameter, so that further information about the handling of a specific reel during the processing process converge. In particular, a transverse position of the irregularity can also be determined in correlation with the running parameter in order to be able to obtain further information for a conclusion on a cause of the irregularity in this respect as well.

In the context of the invention, the database can advantageously be provided on a server and/or an internal storage unit of the unwinding device. In this case, an external server can be understood as a computing unit which has a storage capacity for the database and is provided outside the unwinding device. So the external server can be exemplarily part of a palletizing system or can be located externally at a service company. Thus, the storage of the data may be outsourced for example, to use the capacities of a provider of computing power and/or storage capacity, so that costs of the unwinding device can be reduced. This can, for example, only have one communication interface, so that the unwinding device can communicate with the database on the external server. Furthermore, the external server can also be connected, for example, to a winding device or can be part of a winding device, so that data of the reels to be processed are transmitted directly back to the production process of the reels. Additionally or alternatively, it is suggested that the database is provided on an internal storage unit and/or a mobile storage unit. Thus, for example, the unwinding device itself comprises a corresponding storage unit, which is built into the unwinding device, for example, as an internal HDD or SSD hard drive and thus the generated data is directly available on the unwinding device. A mobile storage unit has the advantage that it can be connected to the unwinding device, for example, via a USB interface, while the data is being transmitted and can then be transported as desired in order to provide the data, for example, to a development department.

In the context of the invention, it is also conceivable that the monitoring method further comprises the following step:

visual and/or acoustic output of a warning signal when the irregularity is detected or the irregularity is of a predefined type of irregularity.

By the warning signal, for example, an operator of the unwinding device can be informed about the occurrence of the irregularity, so that he can initiate corresponding counter actions or response actions. The warning signal can, for example, be issued via a warning light, or a display can display the warning signal. Additionally or alternatively, it is conceivable that an acoustic signal will be output, such as a warning tone via a loudspeaker. A predefined type of irregularity can be understood in a sense that, for example, a particular type of defect in the web material is particularly critical and, accordingly, requires the warning signal, while other types of defects of the web material are merely recorded and correlated with the running parameter accordingly. For example, an altered slip at the advance may be uncritical and therefore require no warning signals, however, an absent printed image may require appropriately fabricated succeeding products to be sorted out or the unwinding process to be interrupted.

Furthermore, in a monitoring method according to the invention, it can be provided that the monitoring method comprises the following step:

visualizing the correlation of the irregularity to the running parameter.

The visualization can occur for example on a display, wherein, for example, a diagram may be displayed which indicates the occurrence of irregularities with respect to running parameters. As a result, an operator of the unwinding device can be indicated, for example, an accumulation of the irregularity in a specific running parameter range, so that he can draw conclusions from the existing correlation already at the unwinding device. Thus, the display may preferably be arranged on the unwinding device. Additionally or alternatively, it may be provided that the visualization of the correlation between the irregularity and the running parameter is performed on a display outside the unwinding device. For example, it may be provided that the unwinding device is in communication connection with a network, so that the data can be transmitted to a monitoring station and/or directly to a development department in order to convey an evaluation directly to an evaluating station. Thus, visualization can simplify the monitoring method and increase the comfort, in particular for the persons involved, so that ultimately time can be saved in the evaluation.

Furthermore, in a monitoring method according to the invention, it is conceivable that the monitoring method further comprises the following step:

determining a probability of a cause of the irregularity in a production process of the web material and/or in the unwinding process.

Thus, for example, a probabilistic determination can already be performed automatically from an accumulation of irregularities in the region of a certain running parameter or from the correlation of a single irregularity with the running parameter. As a result, it may not be necessary to perform an evaluation manually. In this case, the probability can be determined by a computing unit of the unwinding device and therefore a reproducible result can be output. Furthermore, the monitoring method can thereby be further automated, wherein a uniform basis can be created in order to determine the relation or the probability.

In the context of the invention, it can further be intended that the irregularity comprises a process parameter which lies outside of a parameter range. For example, the parameter range can have at least one parameter limit, from which the irregularity is defined. Therefore, if the process parameter exceeds or falls below this parameter limit, an irregularity is assumed. So the parameter limit can be an absolute or a relative limit. Preferably, two parameter limits are provided which define a closed parameter range downwards and upwards. Exemplary parameter limits may be the opacity of a printed image, the transparency of a film material, or a tolerable slip at the advance. As already described, these parameter limits can be configured absolutely, i.e. be predefined or will be predefined at the beginning of the monitoring method. Additionally or alternatively, relative parameter limits may be provided which, for example, define an irregularity such that the process parameter, for example, is wound over a certain length dynamically during the unwinding process and a certain percentage above and/or below is considered as an irregularity.

In a monitoring method according to the invention, it is also conceivable that a number of products produced from the web material are determined based on of the running parameter. Preferably, the products may be sacks made from plastic film. Thus, it is possible by the running parameter and in particular by taking into account any unprocessed irregularities of the web material to perform a calculation of the total length and/or total area of the web material. As a result, in turn, the number of products produced from the web material can be calculated from a specific reel. In comparison with an estimation of the weight of the reel, there is also the advantage that the determination based on the running parameter is substantially or completely adjusted by an optionally fluctuating thickness of the web material.

The order of the individual method steps of a monitoring method according to the invention can be performed in the described order. Furthermore, however, another than the respective described order of the method steps is conceivable. In particular, individual method steps or all method steps can be repeated and/or executed in parallel.

In particular, the object is further achieved by a quantification method for determining a number of products produced from a web material in an unwinding process of an unwinding device, comprising the following steps:

at least partially unwinding the web material from a reel, detecting at least one running parameter of the reel, calculating the number of products produced from the web material, in particular sacks, based on the running parameter of the reel, in particular wherein at least one irregularity of the web material and/or the unwinding process is taken into account.

Thus, another aspect of the present invention might lie in the quantification method. This results in the advantage that the determination based on the running parameter can be substantially or completely adjusted by a possibly fluctuating thickness of the web material. In particular, features and details that have been described in connection with the monitoring method according to the invention and/or the unwinding device according to the invention and/or the unwinding system according to the invention, of course, also apply in connection with the quantification method according to the invention and in each case vice versa, so that with respect to the disclosure of the individual inventive aspects always mutual reference is or can be drawn. In particular, the features of the respective characterizing part of the present dependent claims of the monitoring method according to the invention can also represent further developments of the quantification method.

According to a further aspect of the invention, an unwinding device for performing an unwinding process of a web material from a reel is claimed. Preferably, the unwinding process can be monitored by a monitoring method according to the invention. The unwinding device has a reel holder on which the reel can be stored during the unwinding process. Furthermore, the unwinding device has a driving means, by which a propulsion of the web material can be generated, and a detection unit, by which at least one irregularity of the web material and/or the unwinding process can be detected. The detection unit is in communication connection with a computing unit, wherein a correlation of the irregularity to at least one running parameter of the reel can be determined by the computing unit.

The detection unit can be configured for optical and/or acoustic detection of the irregularity. For example, the detection unit may comprise a camera and/or an ultrasound sensor. Furthermore, the detection unit can have means for measuring force and/or torques. Depending on the nature of the irregularity to be detected, the detection unit can be arranged on the driving means, on the reel holder and/or on a frame of the unwinding device. Depending on the application, however, other arrangements are conceivable. Furthermore, the computing unit may be part of a computer or a control. For example, a control device of the unwinding device may comprise the computing unit. The driving means may preferably comprise two driven rolls which are in contact with the web material so that the web material undergoes propulsion when driving the driving means. In this case, the driving means may have a particular textured surface through which the advance of the web material is realized by friction. The reel holder may preferably comprise a reel mandrel, on which the reel is pushed to perform the unwinding process, so that it is rotatably mounted on the unwinding device. Preferably, the detection unit and/or at least one measuring means for detecting the running parameter can be arranged on the reel holder.

Thus, an unwinding device according to the invention brings about the same advantages as have already been described in detail with reference to an inventive monitoring method. Thus, the irregularity can be detected by the detection unit and a correlation can be established by the computing unit, in particular by which a conclusion on a cause of the irregularity is improved by the relation with the running parameter. The running parameter can preferably be detected by a measuring means and/or the detection unit and/or the computing unit. In this case, the correlation can be produced by the computing unit, for example, by the fact that the computing unit assigns the irregularity to the running parameter, for example, by isolating a measured value and writing it assignable in a table according to the other measured value. Preferably, the computing unit can execute a computer program which establishes the correlation. Furthermore, the unwinding device, in particular the computing unit of the unwinding device, can be configured to perform a quantification method for determining a number of products produced from the web material.

In the case of an unwinding device according to the invention, it is also conceivable that the unwinding device is configured to produce sacks made of the web material, in particular of tubular and/or flat web material. For this purpose, the unwinding device may have at least one folding means for folding the sacks and/or at least one closing means for closing the sacks. Thus, the closing means may be configured to form a fold and/or to weld the web material to close the sacks. The folding means may comprise a guiding means through which the web material can be conducted, in particular during propulsion, so that a sack shape is formed at least partially from the web material. Furthermore, the unwinding device can have at least one filling means, by means of which sacks produced from the web material can be filled. Thus, the unwinding device may be adapted to produce sacks ready for delivery from the web material and/or fill products, in particular so that the entire production process of the sacks from the delivery of the raw material (e.g., web material and fill products) can be projected by the unwinding device. By detecting one or more irregularities, rejects can be reduced at the same time and/or delivery of defective sacks can be avoided. The unwinding device thus preferably comprises a so-called FFS machine. FFS is an abbreviation for "form, fill and seal".

In the context of the invention, it is also conceivable that the computing unit is in communication connection with a measuring unit for detecting an advance parameter on the web material. In particular, the measuring unit may additionally be configured to measure a number of rotations of the reel. In this case, the measuring unit may be part of the detection unit or form an independent structural unit within the unwinding device. For example, a measuring means for measuring the number of rotations of a driving means can be provided. The number of rotations may in particular comprise one rotation angle. Furthermore, the driving means may comprise at least one drive roll which by rotation drives the web material via friction and has a fixed diameter. Via the number of rotations and the diameter the actual propulsion of the web material can then be determined by the measuring unit and/or the computing unit. This can preferably be corrected by measuring a number of rotations in order to achieve increased accuracy. Thus a simple way can be given to determine the actual propulsion of the web material and thus the running parameter, wherein a diameter of the reel plays no or only a minor role.

Preferably, a calculation of the running parameter can be performed by the computing unit. For example, the calculation can be performed based on a measurement of an advance of the web material and in particular on a measurement of a number of rotations of the reel. For example, the number of rotations of the reel can serve to consider a slip at the advance in the calculation, and thus to improve the accuracy of the calculation result or the measurement result at the advance.

In an unwinding device according to the invention, the computing unit can advantageously have a communication interface for data communication with a database, so that the correlation of the irregularity to the running parameter can be entered into the database via the communication interface. The communication interface may comprise a network connection or the like for wired transmission from the computing unit to the database. Additionally or alternatively, the communication interface may enable wireless communication and comprise, for example, a WLAN unit. The database can also be provided on a storage medium, which, for example, may be part of the unwinding device. As a result, the computing unit can be in communication connection with the storage unit, for example, directly via an internal wired connection. Thus, the storage unit may have a computer program for performing a monitoring method and/or for establishing the correlation between the running parameter and the irregularity. Thus, the database may be provided in particular on an external server and/or on an internal storage unit of the winding device. Additionally or alternatively, the database may be provided on a mobile storage unit. For example, the communication interface can be a USB interface through which, for example, an external hard drive can be connected with the computing unit, so that the database can be transported. The database allows a number of irregularities and running parameters to be correlated and retrieved at a later time to identify particular patterns.

It is also conceivable that, in an unwinding device according to the invention, the computing unit is in communication connection with an output unit and configured to output a visual and/or acoustic warning signal via the output unit when the irregularity is detected or the irregularity is of a predefined type of irregularity. For example, the output unit may comprise a display, a light, and/or a loudspeaker to display or emit the warning signal. In this case, an operator of the unwinding device can be informed by means of a warning signal, so that it is not necessary for him to constantly keep an eye on the unwinding device, but nevertheless be informed via the output unit when a problem or a process-relevant event occurs.

According to a further aspect of the invention, an unwinding system for performing an unwinding process of a web material from a reel is claimed. Preferably, the unwinding process can be monitored by a monitoring method according to the invention. The unwinding system further comprises an unwinding device, which is preferably an unwinding device according to the invention. In this case, the unwinding device has a reel holder, on which the reel can be stored during the unwinding process, and a driving means, by which a propulsion of the web material can be generated, and a detection unit by which at least one irregularity of the web material and/or the unwinding process can be detected. The detection unit is in communication connection with a computing unit, wherein a correlation of the irregularity to at least one running parameter of the reel and can be determined by the computing unit.

Thus, an unwinding system according to the invention brings about the same advantages as have been described in detail with reference to an unwinding device according to the invention and/or a monitoring method according to the invention.

Preferably, in an unwinding system according to the invention, an external server can be provided with a database which is in a communication connection with the computing unit, so that the correlation of the irregularity to the running parameter can be entered in the database via the communication interface. As a result, the unwinding system can be distributed over several locations, for example, and thus at least partially structurally decouple the server from the unwinding device. Thus, the server can be located at an external service provider, so that, for example, several unwinding devices can be in communication connection with the same server. Thus, on the one hand, costs can be saved if the server is not part of the unwinding device, and on the other hand, several unwinding devices can use the same database to draw conclusions about causes of for example recurring irregularities to be able to produce with improved accuracy. Thus, the irregularities and running parameters or their correlation can also be assessed externally in order to draw conclusions from them. Based on these findings, a production process of web material and/or a winding processes can then be improved.

Figure 2:
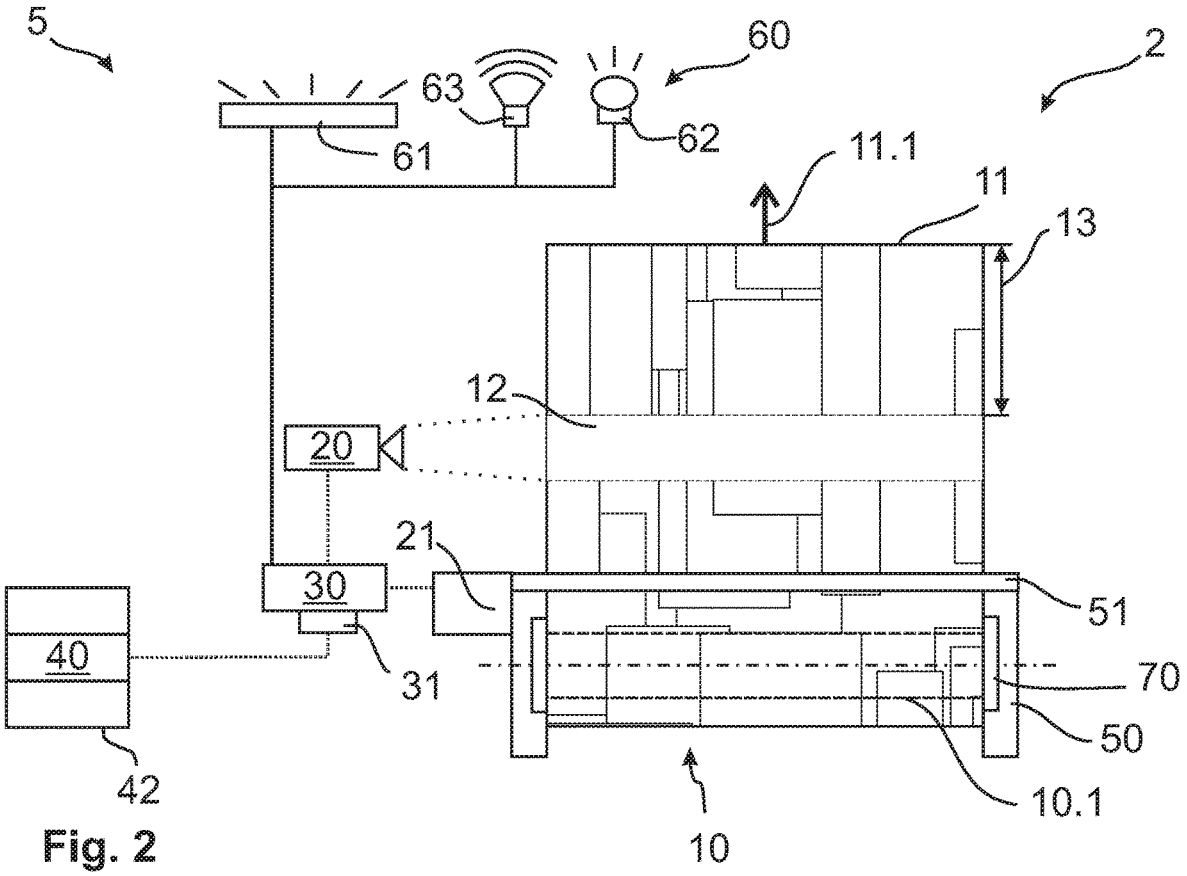
Figure 3:
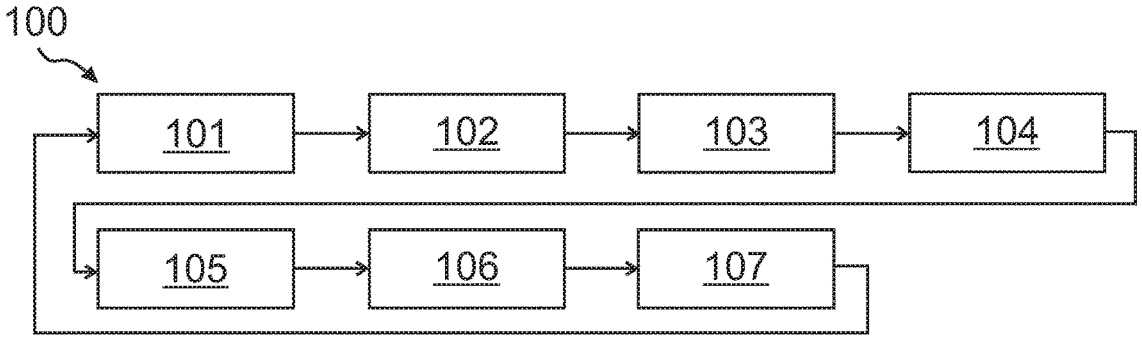
Figure 4A:
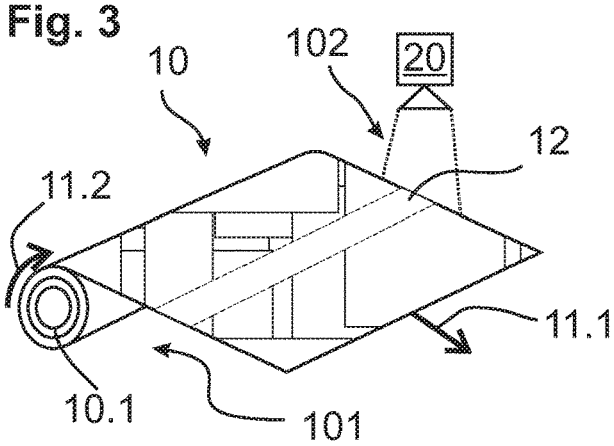
Figure 4B:
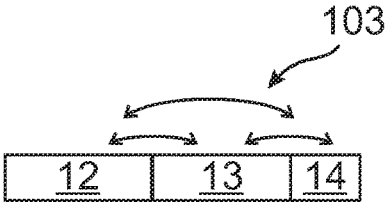
Figure 4C:
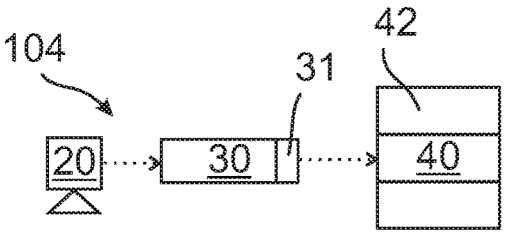
Figure 4D:
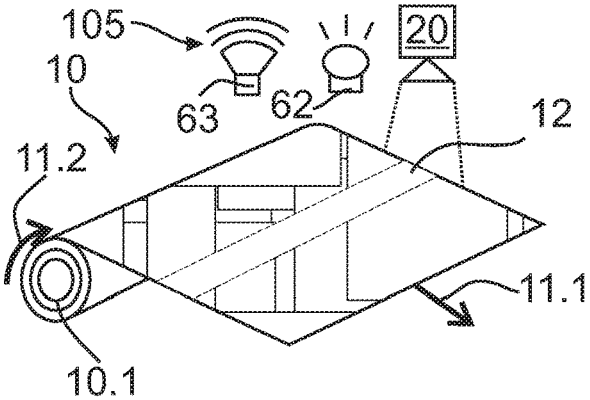
Figure 4E:
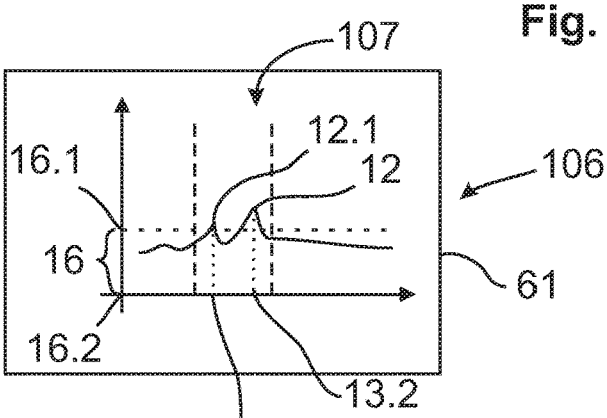
Figure 5A:
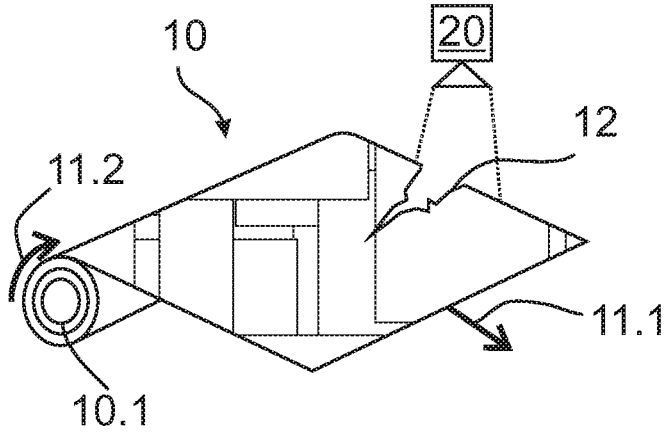
Figure 5B:
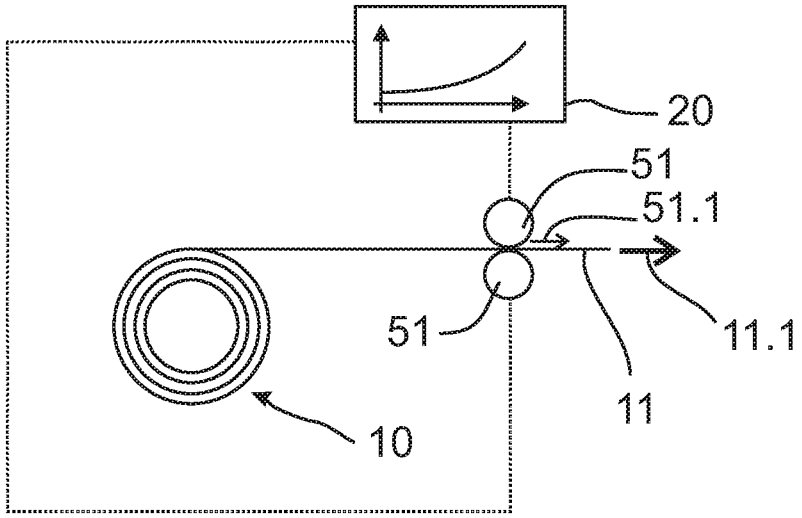
Figure 5C:
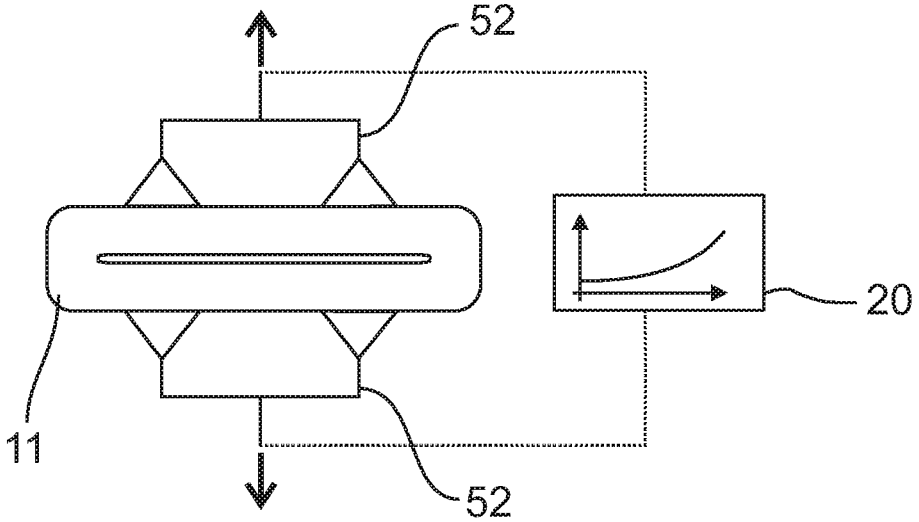

Further, measures improving the invention will become apparent from the following description of some embodiments of the invention, which are schematically illustrated in the figures. All of the resulting features and/or advantages including design details, spatial arrangements and method steps of the claims, the description or the drawings may be essential to the invention both in itself and in various combinations. It should be noted that the figures are merely descriptive and are not intended to limit the invention in any way. The figures show:

FIG. 1: an unwinding system according to the invention with an unwinding device according to the invention in a first exemplary embodiment in a schematic plan view;

FIG. 2: an unwinding system according to the invention with an unwinding device according to the invention in a second exemplary embodiment in a schematic plan view;

FIG. 3: an inventive monitoring method in a schematic illustration of the method steps in a third embodiment;

FIG. 4*a*-4*e*: a further, schematic illustration of method steps of the monitoring method of the third exemplary embodiment, FIG. 5*a*-5*c*: examples of irregularities within an unwinding process.

In the following figures, the identical reference signs are used for the same technical features of different embodiments.

FIG. 1 shows an unwinding system 5 according to the invention for performing an unwinding process of a web material 11 by means of an unwinding device 2. The unwinding device 2 comprises a reel holder 70 on which a reel 10 can be stored, or is stored during the unwinding process. In this case, the reel 10 comprises a reel sleeve 10.1 and at least partially a web material 11. During the unwinding process, the web material 11 is removed substantially flat from the reel 10. In this case, the reel holder 70 is configured to rotatably store the reel 10, so that the reel 10 rotates during the unwinding of the web material 11 accordingly. In order to realize a propulsion 11.1 of the web material 11, a driving means 50 is also provided. The driving means 50 can be configured, for example, to rotate the reel 10 and/or comprise a drive roll 51 which rolls off with the web material 11 to thereby pull the web material 11 from the reel 10. As a result, it can also be provided, for example, that the reel 10 is mounted only rotationally on the reel holder 70, so that the rotation can be realized from an advance by the drive rolls 51. Furthermore, a detection unit 20 is provided by which at least one irregularity 12 of the web material 11 and/or the unwinding process can be detected. The irregularity 12 is shown in FIG. 1 as the absence of a printed image. The detection unit 20 therefore comprises a camera for optically detecting the web material 11 and the irregularity 12. Furthermore, a measuring unit 21 is provided, by which the propulsion 11.1 of the web material 11 can be detected and a measurement of a number of rotations 11.2 of the reel 10 is possible. The detection unit 20 and the measuring unit 21 are in communication connection with a computing unit 30, so that a correlation between the irregularity 12 and a running parameter 13 can be determined by the computing unit 30. For example, the running parameter 13 may comprise a length of the unwound web material 11 to the irregularity 12 and/or a length of the web material 11 to the end of the irregularity 12. Thereby, a position of the irregularity 12 on the web material 11 with respect to the reel 10 can be determined. The computing unit 30 also has a communication interface 31 in order to be able to enter the irregularity 12 in correlation with the running parameter 13 into a database 40. In this case, the database 40 is provided as part of an internal storage unit 41 of the unwinding device 2 and is preferably connected directly wired to the computing unit 30 via the communication interface 31. The computing unit 30 can preferably execute a computer program, by means of which the correlation between the irregularity 12 and the running parameter 13 can be generated. Preferably, the correlation can arise from the fact that the running parameter 13 is entered in the database 40 by the computing unit 30 assignable with the irregularity 12. The correlation allows a conclusion to a production process of the reel 10 and/or on the unwinding process. Thus, in particular in the reel 10, the irregularity 12 can be localized. In this case, an occurrence of a certain irregularity 12 in the core, e.g. can suggest that the reel 10 has been wrapped too strong. In addition, the computing unit 30 is in communication connection with an output unit 60, so that a visual and/or acoustic warning signal can be output via the output unit 60 when the irregularity 12 is detected or the irregularity 12 is of a predefined irregularity type. For example, the irregularity 12 may be defined such that a printed image is absent over a certain length of the web material 11 and in this case a warning signal is output to the output unit 60. To output the warning signal, the output unit 60 may comprise a wide variety of output means. Thus, a light source 62 and/or a loudspeaker 63 can be provided for outputting the warning signal. Preferably, the output unit 60 further comprises a display 61 on which, on the one hand, different parameters of the unwinding process can be displayed and, on the other hand, the warning signal can be output. Instead of the absence of the printed image, other types of irregularity can be considered. Thus, also different types of irregularity can be detected by the detection unit 20. Furthermore, the detection unit 20 may, for example additionally or alternatively comprise measuring means for measuring a force or a torque of the reel 10 and/or the web material 11. Further exemplary types of irregularity are further illustrated in FIGS. 5*a* to 5*c*. Preferably, a determination of a number of products produced from the web material 11 can also be performed by the computing unit 30, so that these are determined instead of counting based on the running parameter 13 and thus the number can be assigned to the reel 10. In particular, a quantification method for determining the number of products produced from the web material 11 can thus be performed by the unwinding device 2 of the unwinding system 5.

FIG. 2 shows an unwinding system 5 according to the invention for performing an unwinding process of a web material 11 from a reel 10. The unwinding system 5 of FIG. 2 of the second embodiment substantially corresponds to the unwinding system 5 of the first exemplary embodiment. Instead of an internal storage unit of an unwinding device 2 of the unwinding system 5, however, an external server 42 is provided which has a database 40. The server 42 is in communication connection with a computing unit 30, so that a correlation of an irregularity 12 to a running parameter 13 can be entered into the database 40 via a communication interface 31. The communication interface 31 may comprise, for example, an Internet access, which may be configured wired and/or wireless. For example, the unwinding device 2 may comprise a SIM card in order to establish a communication connection with the external server 42. Because the external server 42 is outsourced, several unwinding devices 2 can be in communication connection with the server 42 in order to be able to concentrate the collected data and possibly relate them. As a result, further knowledge about the occurrence of the irregularities can be obtained and/or the accuracy of statements made thereby can be improved. Furthermore, the external server 42 can be cost effective for the unwinding device 2, as the unwinding device 2 itself does not have the database 40 for example and thus an additional internal storage unit is not necessary or can be used for redundancy to improve data security. In particular, a quantification method for determining a number of products produced from the web material 11 can also be performed by the unwinding system 5 according to FIG. 2.

FIG. 3 shows a monitoring method 100 according to the invention for monitoring an unwinding process of an unwinding device 2 in a further exemplary embodiment in a schematic illustration of the method steps. In this case, the monitoring method 100 comprises at least partially unwinding 101 of a web material 11 from a reel 10, as also shown in FIG. 4*a*. In this case, the propulsion 11.1 can be realized, for example, by a driving means 50 of an unwinding device 2. In addition, the monitoring method 100 comprises detecting 102 at least one irregularity 12 of the web material 11 and/or the unwinding process. Thus, when unwinding the web material 11 from the reel 10, it can be determined by a detection unit 20 that a certain process parameter deviates. This may, for example, be the fading of a printed image, so that in particular the region of the irregularity 12 is detected as such. Furthermore, determining 103 of a correlation between the irregularity 12 and at least one running parameter 13 of the reel 10 is provided. The running parameter 13 may, for example, comprise a length 13 to the beginning of the irregularity 12 from the unwound end of the web material 11 and/or a length to the end of the irregularity 12. In particular, an average of the lengths may be formed and/or both lengths can be correlated with the irregularity 12. Such a correlation is also illustrated, for example, in FIG. 4*b*, wherein the correlation comprises an assignability of the irregularity 12 and of the running parameter 13. Preferably, it may further be provided that the irregularity 12 is correlated with a time indication 14, so that the time of occurrence of the irregularity 12 in the unwinding process can be determined later. Thus, entering 104 of the correlation can occur and/or the correlation can be established by entering the irregularity 12 and the running parameter 13 into a database 40 or can already be established beforehand and entered into the database 40 accordingly. In this case, it is illustrated, for example, in FIG. 4*c* that the detection unit 20 provides signals to a computing unit 30, which enters the irregularity 12 and the running parameter 13 in the database 40 via a communication interface 31. Preferably, the database 40 is thus part of an unwinding system 5 and may be part of an internal storage unit 41 of an unwinding device 2 or, as shown in FIG. 4*c*, may be provided on an external server 42. Preferably, the monitoring method 100 further comprises a visual and/or acoustic output of a warning signal 105 when the irregularity 12 is detected or the irregularity 12 is of a predefined type of irregularity. The visual and/or acoustic output 105 is further illustrated in FIG. 4*d*, wherein a light source 62 of a display unit 60 is provided to visually output the warning signal and a loudspeaker 63 is provided to acoustically output the warning signal. Further advantages arise when the method 100 comprises a visualizing 106 the correlation between the irregularity 12 and the running parameter 13. Such a visualization 106 is shown in FIG. 4*e*, wherein, for example, a graph can be displayed on a display 61 of the output unit 60, which plots a process parameter in relation to a running parameter 13. In the illustrated exemplary embodiment, the process parameter is preferably a transparency of a printed image, although various other types of process parameters are conceivable here. As shown, a parameter range 16 may be provided which is defined by at least one parameter limit 16.1, preferably by two parameter limits 16.1, 16.2. If the process parameter exceeds one of the parameter limits 16.1 or falls below one of the parameter limits 16.2, an irregularity 12 is assumed. In this context, a plurality of irregularities 12, 12.1 in the context of the visualization 106 can also be correlated with a plurality of values 13.1, 13.2 of the running parameter 13 and can be represented in the graph. Thus, furthermore, a determination 107 of a probability of a relation of the irregularity 12 with a production process of the web material 11 and/or with the unwinding process can be performed. Thus, for example, another region may be defined in which an occurrence of the irregularities 12, 12.1 indicates a cause in the production process of the web material 11 and an occurrence of an irregularity 12 outside this region indicates a cause in the unwinding process. Preferably, the determination 107 of the probability can be performed automatically, so that a degree of automation of the method is further increased and thus costs can be saved and a reproducibility is improved. In particular, with the monitoring method 100 and/or individual method steps of the monitoring method 100, a quantification method for determining a number of products produced from the web material 11 can be performed.

FIGS. 5*a* to 5*c* show further types of irregularities. For example, FIG. 5*a* shows the formation of a tear in the web material 11, which can be detected optically by a detection unit 20. Thus, for example, a certain length of a tear may be tolerable and, as of a certain length of the tear, it may be classified as an irregularity 12. FIG. 5*b* furthermore shows a further possible irregularity 12, wherein a driving means 50 comprises drive rolls 51, which provide propulsion 11.1 of the web material 11. If it is determined by a detection unit 20, for example, that an advance parameter 51.1 deviates from a desired value, an increased slip on the drive rolls 51 can be detected and thus define an irregularity 12. The slip can be e.g. a difference between an actual propulsion of the web material 11 and the advance parameter 51.1. FIG. 5*c* further shows an opening of a film tube, wherein the web material 11 is provided, at least in a middle region, in two layers which are connected at the outer sides of the web material 11. In order to bring the web material 11 in the form of a tube, it can be provided that suction means 52 in each case suck in and pull apart a surface of the web material 11, so that the tube is formed from the previously flat web material 11. By certain events within the process, it may happen that a suction force is not sufficient and the web material 11, for example, has blockings. As a result, it may not be possible by the suction means 52 to open the web material 11 at a certain position, wherein several suction attempts may be provided here. Several suction attempts can also be classified as irregularity 12 and reported to a computing unit 30. Thus, for example, a force measurement of the suction means 52 may be provided by the detection unit 20, wherein at an increased force or a sudden drop in force this can be detected as an irregularity 12 by the computing unit 30.

The above explanation of the embodiment describes the present invention solely by way of examples. Of course, individual features of the embodiment, if technically reasonable, can be freely combined without departing from the scope of the present invention. In particular, a quantification method for determining a number of products produced from a web material can also be combined with individual or all features of the embodiments, if technically reasonable.

LIST OF REFERENCE SIGNS

2 unwinding device
5 unwinding system
10 reel
10.1 reel sleeve
11 web material

12 irregularity
13 running parameter
14 time indication
16 parameter range
16.1 first parameter limit
16.2 second parameter limit
20 detection unit
21 measuring unit
30 computing unit
31 communication interface
40 database
41 internal storage unit
42 external server
50 driving means
51 drive roll
52 suction means
60 output unit
61 display
62 light source
63 loudspeaker
70 reel holder
100 monitoring method
101 at least partially unwinding
102 detecting of 12
103 determining a correlation
104 entering in 40
105 output of a warning signal
106 visualizing the correlation
107 determining a probability

The invention claimed is:

1. A monitoring method for monitoring an unwinding process of an unwinding device, comprising the following steps:

at least partially unwinding a web material from a reel by a driving device, detecting at least one irregularity of the web material and/or the unwinding process by a detection unit, and determining a correlation of the irregularity to at least one running parameter of the reel by a computing unit, wherein the running parameter is determined by the computing unit by detecting an advance parameter of the web material at the driving device by a measuring unit, and wherein additionally a measurement of a number of rotations of the reel is performed by the measuring unit.

2. The monitoring method according to claim 1, wherein the running parameter is determined by the computing unit during the unwinding of the web material from the reel.

3. The monitoring method according to claim 1, wherein the monitoring method further comprises the following step:

entering the correlation of the irregularity to the running parameter in a database by a communication interface.

4. The monitoring method according to claim 3, wherein the irregularity is correlated with a time indication by the computing unit when entering the correlation in the database.

5. The monitoring method according to claim 3, wherein the database is provided at least on an external server or an internal storage unit of the unwinding device.

6. The monitoring method according to claim 1, wherein the monitoring method further comprises the following step:

at least visual or acoustic output a warning signal when the irregularity is detected or the irregularity is of a predefined type of irregularity by an output unit.

7. The monitoring method according to claim 1, wherein the monitoring method further comprises the following step:

visualizing the correlation of the irregularity to the running parameter by a display.

8. The monitoring method according to claim 1, wherein the monitoring method further comprises the following step:

determining a probability of a cause of the irregularity at least in a production process of the web material or in the unwinding process by the computing unit.

9. The monitoring method according to claim 1, wherein the irregularity comprises a process parameter which is located outside of a parameter range.

10. The monitoring method according to claim 1, wherein a number of products produced from the web material is determined based on the running parameter by the computing unit.

11. An unwinding device for performing an unwinding process of a web material from a reel, comprising:

a reel holder on which the reel can be stored during the unwinding process, a driving device, by which a propulsion of the web material can be generated, and a detection unit, by which at least one irregularity of at least the web material or the unwinding process can be detected, wherein the detection unit is in a communication connection with a computing unit, wherein a correlation of the irregularity to at least one running parameter of the reel can be determined by the computing unit, wherein for determination of the running parameter by the computing unit, the computing unit is in a communication connection with a measuring unit for detecting an advance parameter of the web material at the driving device, and wherein the measuring unit is additionally configured to measure a number of rotations of the reel.

12. The unwinding device according to claim 11, wherein a calculation of the running parameter can be performed by the computing unit.

13. The unwinding device according to claim 11, wherein the computing unit has a communication interface for data communication with a database, so that the correlation of the irregularity to the running parameter can be entered into the database via the communication interface.

14. The unwinding device according to claim 11, wherein the computing unit is in a communication connection with an output unit and is configured to output at least a visual or acoustic warning signal via the output unit when the irregularity is detected or the irregularity is of a predefined type of irregularity.

15. An unwinding system for performing an unwinding process of a web material from a reel, comprising:

an unwinding device, with a reel holder on which the reel can be stored during the unwinding process, a driving device, by which a propulsion of the web material can be generated, and a detection unit, by which at least one irregularity of at least the web material or the unwinding process can be detected, wherein the detection unit is in a communication connection with a computing unit, wherein a correlation of the irregularity to at least one running parameter of the reel can be determined by the computing unit, wherein for determination of the running parameter by the computing unit, the computing unit is in a communication connection with a measuring unit for detecting an advance parameter of the web material at the driving device, and wherein the measuring unit is additionally configured to measure a number of rotations of the reel.

16. The Unwinding system according to claim 15, wherein an external server is provided with a database which is in a communication connection with the computing unit via a communication interface, so that the correlation of the irregularity to the running parameter can be entered in the database.

17. A monitoring method for monitoring an unwinding process of an unwinding device in form of a form, fill and seal (FFS) machine which is configured to produce sacks made of a web material comprising a plastic film, the method comprising the following steps:

at least partially unwinding the web material from a reel by a driving device, detecting at least one irregularity of the web material and/or the unwinding process by a detection unit, and determining a correlation of the irregularity to at least one running parameter of the reel by a computing unit, wherein the running parameter is determined by the computing unit by detecting an advance parameter of the web material at the driving device by a measuring unit, and wherein the irregularity comprises at least one of the following features:

unsuccessful opening of a tube of the web material on the unwinding device, breaking up of a product produced from the web material on the unwinding device, tearing of the web material on the unwinding device, absence of at least one part of a printed image on the web material on the unwinding device, increased slip on a driving means during unwinding of the web material on the unwinding device, and at least altered torques or forces during processing of the web material on the unwinding device.

* * * * *